US008780952B2

(12) United States Patent
Schwer et al.

(10) Patent No.: US 8,780,952 B2
(45) Date of Patent: Jul. 15, 2014

(54) ROOF SYSTEM FOR ELECTRIC ARC FURNACE AND METHOD FOR MANUFACTURING THE SAME

(76) Inventors: John W. Schwer, Hammond, IN (US); Thomas J. Schwer, Hammond, IN (US)

( * ) Notice: Subject to any disclaimer, the term of this patent is extended or adjusted under 35 U.S.C. 154(b) by 32 days.

(21) Appl. No.: 12/754,325

(22) Filed: Apr. 5, 2010

(65) Prior Publication Data

US 2011/0243179 A1 Oct. 6, 2011

(51) Int. Cl.
*F27D 1/02* (2006.01)
*C21B 7/06* (2006.01)
*F27D 1/16* (2006.01)

(52) U.S. Cl.
USPC ..... 373/73; 373/71; 373/76; 373/88; 373/93; 373/108; 266/280; 266/283; 266/286; 264/30

(58) Field of Classification Search
CPC ..... F27B 3/085
USPC ..... 373/71, 73–76, 88, 93–94, 108, 113, 373/116, 118, 120, 127, 130, 132, 137; 266/280, 283, 286; 110/331–335; 432/247–252; 264/30
See application file for complete search history.

(56) References Cited

U.S. PATENT DOCUMENTS

| | | | | | |
|---|---|---|---|---|---|
| 1,378,972 | A * | 5/1921 | Moore | 373/62 |
| 2,551,941 | A * | 5/1951 | Greene | 373/73 |
| 2,600,460 | A * | 6/1952 | Antill | 110/335 |
| 3,375,317 | A * | 3/1968 | Hansen et al. | 373/74 |
| 3,717,713 | A * | 2/1973 | Schlienger | 373/72 |
| 3,967,048 | A * | 6/1976 | Longenecker | 373/74 |
| 4,141,483 | A * | 2/1979 | Untilov et al. | 228/193 |
| 4,146,742 | A * | 3/1979 | Longenecker | 373/74 |
| 4,199,652 | A * | 4/1980 | Longenecker | 373/76 |
| 4,589,633 | A * | 5/1986 | Gilson et al. | 266/44 |
| 5,115,184 | A * | 5/1992 | Arthur et al. | 373/74 |
| 6,327,296 | B1 * | 12/2001 | Poloni et al. | 373/74 |
| 2002/0175453 | A1 * | 11/2002 | Connors et al. | 266/280 |
| 2003/0053514 | A1 * | 3/2003 | Manasek et al. | 373/76 |
| 2009/0168831 | A1 * | 7/2009 | Fontaine et al. | 373/73 |

* cited by examiner

*Primary Examiner* — Dana Ross
*Assistant Examiner* — Ket D Dang
(74) *Attorney, Agent, or Firm* — Robert D. Null; Faegre Baker Daniels, LLP

(57) ABSTRACT

A roof system for an electric arc furnace includes a skew removably attached to the electric arc furnace, a lining of refractory material affixed to the skew, and a delta composed of a refractory material. The delta has at least one aperture capable of receiving an electrode. The delta fits onto and is supported by the refractory lining that is affixed to the skew.

11 Claims, 6 Drawing Sheets

ROOF SYSTEM FOR ELECTRIC ARC FURNACE AND METHOD FOR MANUFACTURING THE SAME

FIELD OF THE DISCLOSURE

The present disclosure relates to electric arc furnaces. More specifically, the disclosure relates to a roof delta or roof center apparatus for either direct or alternating current (DC or AC) electric arc furnaces and a method for making the same.

BACKGROUND AND SUMMARY OF THE DISCLOSURE

Electric arc furnaces ("EAFs") are used in various arts, but are largely used in steel production. When used for steel production, generally EAFs are large, cylindrical structures that operate by using arcs of electricity to heat and melt steel scrap. They often include a melting chamber, graphite electrodes, and a roof apparatus. The melting chamber receives the steel scrap, is enclosed by the roof, and the electrodes are then inserted into the melting chamber through the roof. Generally, EAFs are either single phase direct current ("DC") systems or three phase alternating current ("AC") systems (using one electrode for a DC EAF and three electrodes for an AC EAF). The roof system of each EAF is configured accordingly (e.g., a three phase AC EAF would include a roof with three apertures configured to accept three separate electrodes).

In the context of steel production, EAFs melt steel scrap by generating large amounts of heat (e.g., approximately 3,000° F.). The electrodes of an EAF generate such large amounts of heat by arcing between each other as well as to the scrap in the furnace, with oxygen often injected into the melting chamber to aid in heat generation. Accordingly, to be efficient, an EAF must be configured to maintain such high temperatures over a prolonged period of time while simultaneously limiting the amount of heat that escapes.

An EAF's roof is essential to its efficiency as it must be designed to withstand these substantial temperatures over a prolonged period of time. Accordingly, prior art EAF roof systems use large, heavy structures as a means to prevent heat escape and, in turn, allow the EAF to melt steel scrap in an efficient manner. Some of the known, heavy roof structures include a skew and delta. The skew (also known as a water-cooled skew or a delta water ring) is in contact with the furnace and often includes a circuitry of water pipes, which are designed to cool the roof system. More specifically, the prior art water-cooled skews are designed primarily to prevent the skew from melting during the steel making process, and in addition, to cool the delta. However, as discussed below, because of how massive prior art deltas are, the water-cooled skews have little if any cooling effect on the massive prior art deltas. Prior art skews also often include a solid metal round (e.g., cylinder) at the distal end of the skew (i.e., the portion exposed to the melting chamber), which essentially acts as a lightning rod in the event electricity were to arc from the electrodes toward the water pipe circuitry during the steel making process.

The delta is the center piece of the roof system. Deltas are composed of refractory material in order to prevent electricity from arcing between the electrodes and the delta. Refractory material is a non-metallic material that will not conduct electricity from the electrodes and will maintain its physical and chemical properties when exposed to high temperatures. As the center portion of the prior art EAF roof system, the prior art deltas are configured to fit together with the skew. Additionally, prior art deltas are as deep as, if not deeper than, the skew used in prior art systems. Finally, prior art refractory deltas are configured so that the interior surface of the skew is adjacent to the delta during the melting process.

Since the prior art refractory deltas are at least the same depth as the skew, they are also quite heavy, often weighing between 10,000-18,000 pounds. Such large structures are expensive to construct and equally expensive to replace. Additionally, the life span of prior art refractory deltas is relatively short, which, in turn, increases a company's operating costs when using such a roof system. Their short life is primarily attributable to their size as well as the relatively short distance from the molten bath of metal (which is a direct result of prior art deltas being the same depth, if not deeper than, prior art skews). More specifically, the life of a refractory delta is a function of the thermal rating of the refractory material, and continuous exposure to the extreme temperatures required for melting scrap metal eventually causes the refractory material to wear out. This is particularly true when oxygen is used in the melting process, as free oxygen erodes the refractory material in the prior art deltas, especially since the prior art deltas extend the length of the skew and are thus in relatively close proximity with the molten metal in the melting chamber.

The size of prior art deltas not only increases exposure to the heat generated during the melting process (because the bottom of the skew and the bottom of the delta are even), it also makes it very difficult to cool them. The aforementioned water pipes provide some, but limited, cooling of the delta. Also, excess water from water sprayers that are used to cool the electrodes provides some additional cooling (i.e., the electrodes are cooled with continuous streams of water, which splash off the electrodes and on to the delta). However, due to the size of the delta, and how close the bottom of the delta is to the molten metal in the melting chamber, these cooling techniques are inadequate. Thus, the massive deltas need to be replaced more frequently.

An exemplary embodiment of the present disclosure provides a roof system in which the delta is smaller, costs less, and lasts longer than prior art refractory deltas. The present disclosure accomplishes this by employing a new and useful method for making such roof systems. An exemplary method of the present invention includes the steps of creating a first mold and then using the first mold to cast a lining of refractory material to a skew. A second mold is then created and used to cast a delta of refractory material. The refractory delta and refractory-lined skew comprise a part of the roof system of an electric arc furnace.

In another embodiment, an exemplary roof system of the present disclosure includes a skew that is removably attached to an electric arc furnace, the skew having a proximal end, distal end, and an interior surface, a refractory lining that extends from the proximal end of the skew to the distal end thereof, a refractory delta, the delta having a proximal surface, a distal surface and at least one opening capable of receiving at least one electrode, wherein the delta extends distally toward, but not as far as, the distal ends of the skew and refractory lining.

In yet another embodiment, an exemplary roof system comprises a lining of refractory material affixed to the interior surface of a skew of an electric arc furnace, and a delta of refractory material configured to fit on to the lining of refractory material.

And in yet another embodiment, an exemplary roof system comprises a delta of refractory material sized to fit on to the skew. An exemplary method for making this embodiment includes creating a first mold and using the first mold to cast a refractory delta.

BRIEF DESCRIPTION OF THE DRAWINGS

The above mentioned and other features and objects of this disclosure, and the manner of attaining them, will become more apparent and the disclosure itself will be better understood by reference to the following description of embodiments taken in conjunction with the accompanying drawings, wherein.

Corresponding reference characters indicate corresponding parts throughout the several views.

DETAILED DESCRIPTION OF THE DRAWINGS

The embodiments disclosed herein are not intended to be exhaustive or limit the disclosure to the precise forms disclosed in the following detailed description. Rather, the embodiments are chosen and described so that others skilled in the art may utilize their teachings.

Figure 1:
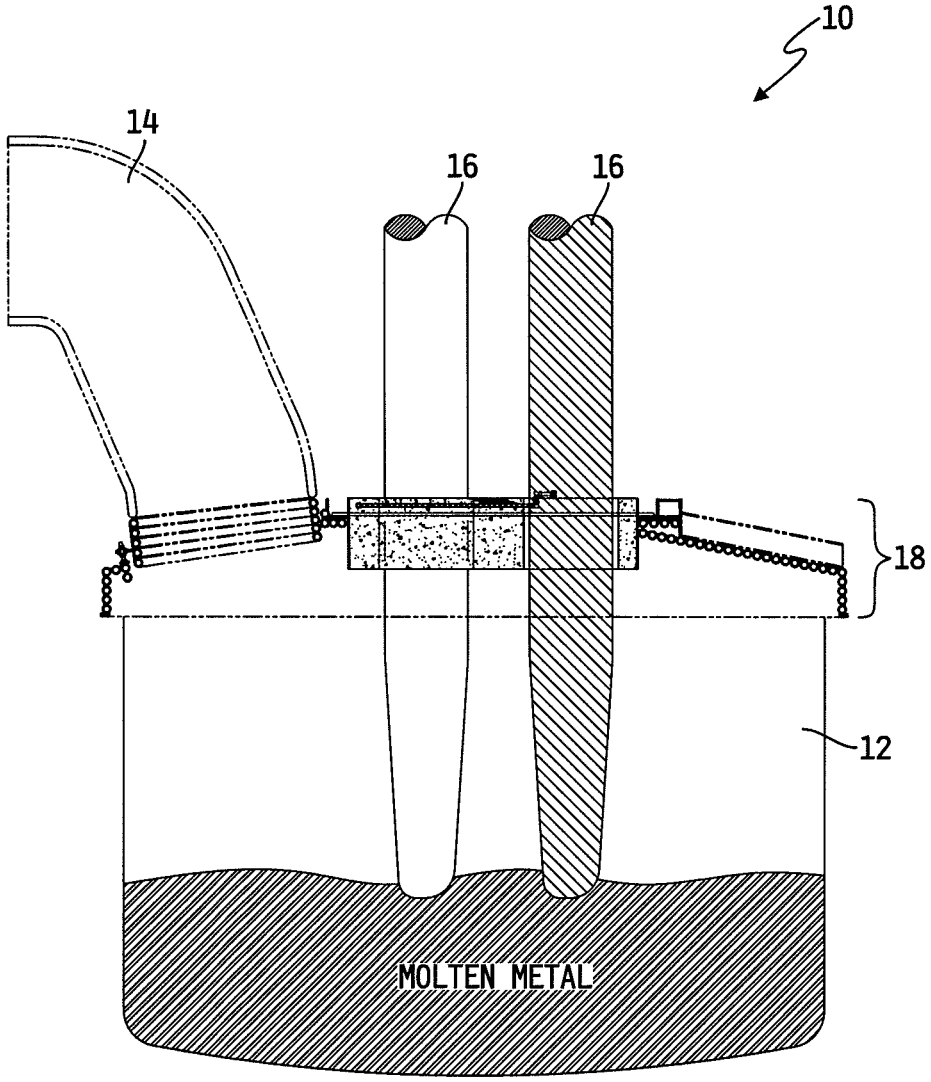
FIG. 1 (PRIOR ART)
FIG. 1 illustrates a perspective view of an exemplary electric arc furnace.

Referring to FIG. 1, an exemplary prior art EAF 10 that does not contain a skew is shown. EAF 10 includes a melting chamber 12, exhaust 14, electrodes 16, and roof system 18. A typical reaction occurs within EAF 10 when steel scrap is placed into melting chamber 12, roof system 18 is closed, electrodes 16 are inserted through roof system 18, electricity is supplied to electrodes 16, and electricity supplied by electrodes 16 then arcs between the electrodes and the steel scrap within melting chamber 12, generating enough energy to melt the steel scrap.

Figure 2:
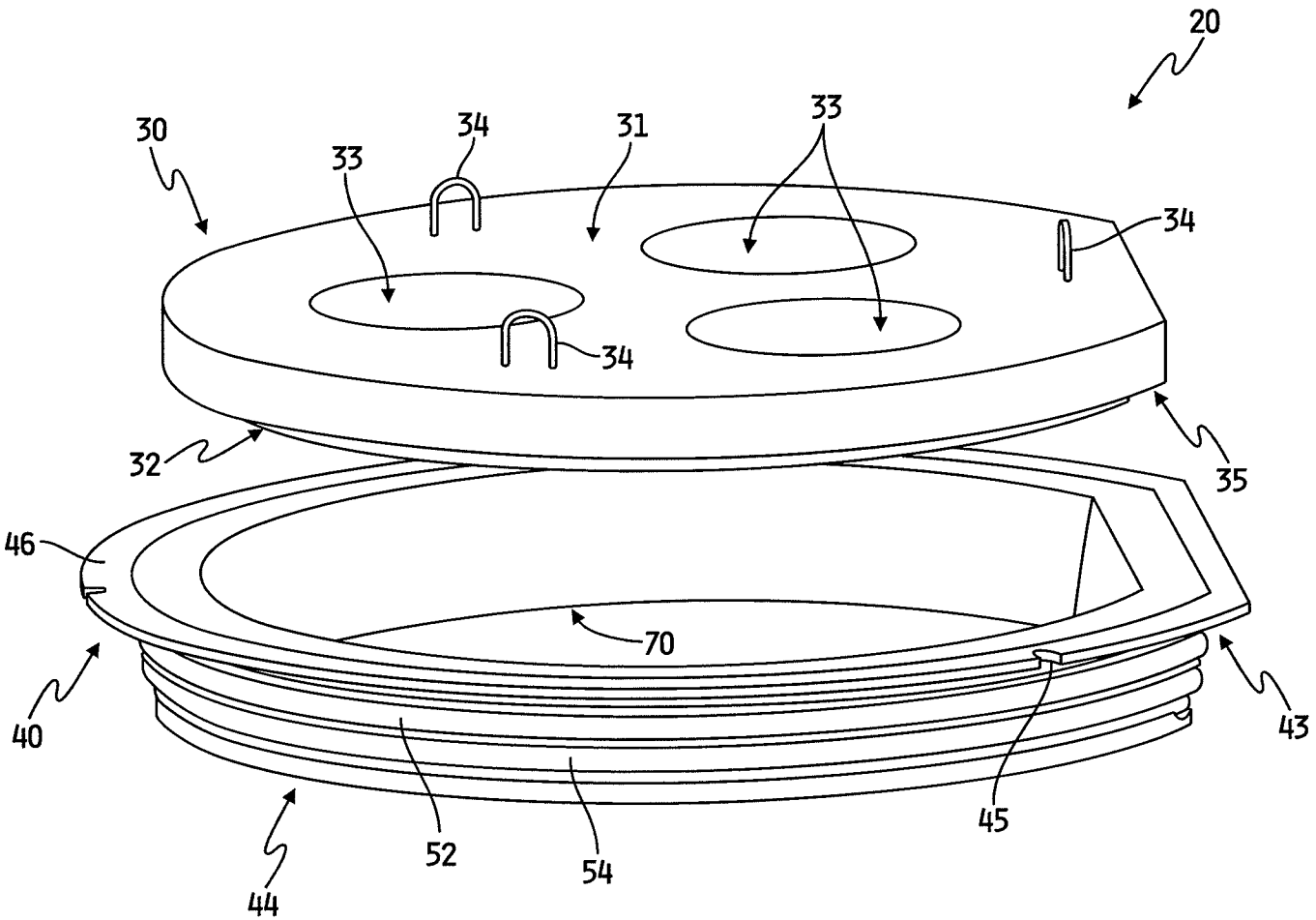
FIG. 2 illustrates a perspective view of an exemplary roof system.

Referring to FIG. 2, an exemplary roof system 20 of the present disclosure includes delta 30, skew 40, and refractory skew lining 70. Delta 30, which is composed of a refractory material, includes an upper surface 31, lower surface 32, lifting apparatus(es) 34, and shoulder 35. It should be understood that shoulder 35 is present in this exemplary embodiment, but that delta 30 may not include shoulder 35. It should also be understood that delta 30 is not limited in shape or structure simply because of its name (i.e., delta 30 may be any shape necessary to configure to the EAF in which it is used). Lifting apparatus(es) 34 are affixed to upper surface 31 (e.g., by being cast into delta 30) and are used in the placement and removal of delta 30. It should also be understood that lifting apparatus(es) 34 are illustrative only; the same placement and removal of delta 30 can occur with any other device suitable for placement and removal of EAF deltas. In this exemplary embodiment, shoulder 35 is formed based on the circumferential difference between lower surface 32 and upper surface 31, as lower surface 32 is smaller in circumference than upper surface 31. Delta 30 also includes at least one aperture 33, which is configured to receive at least one electrode 16. In an exemplary embodiment, a plurality of apertures 33 are configured to receive a plurality of electrodes 16. In this embodiment, delta 30 may be sized to rest on refractory skew lining 70, or alternatively, may be configured to fit together with refractory skew lining 70 (e.g., where delta 30 is shaped as a wedge). Electrodes 16 are inserted through apertures 33 and into melting chamber 12 after delta 30 is positioned on refractory skew lining 70.

Figure 3:
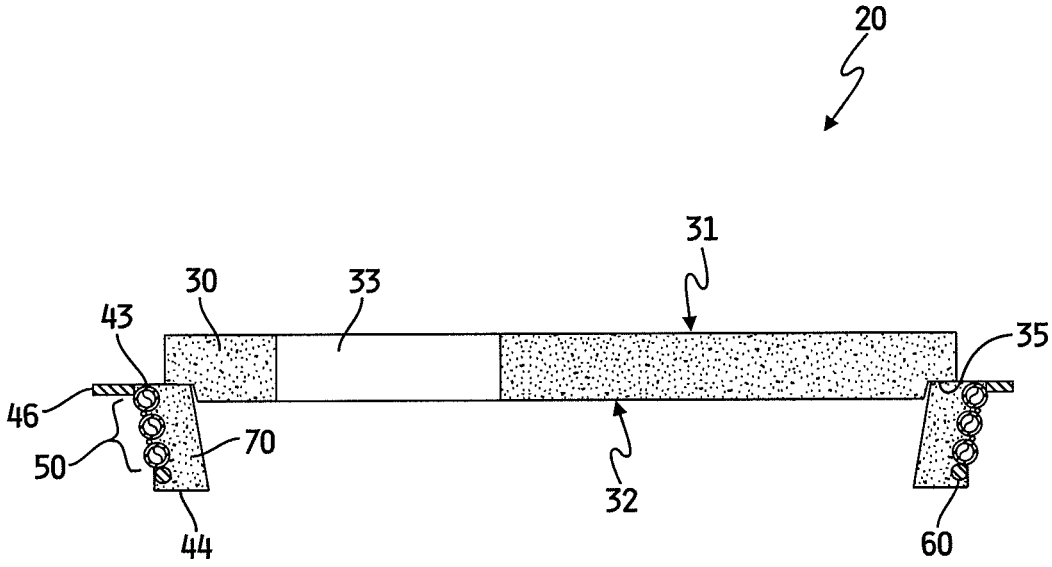
FIG. 3 illustrates a cross-sectional view of an exemplary roof system.
Figure 4A:
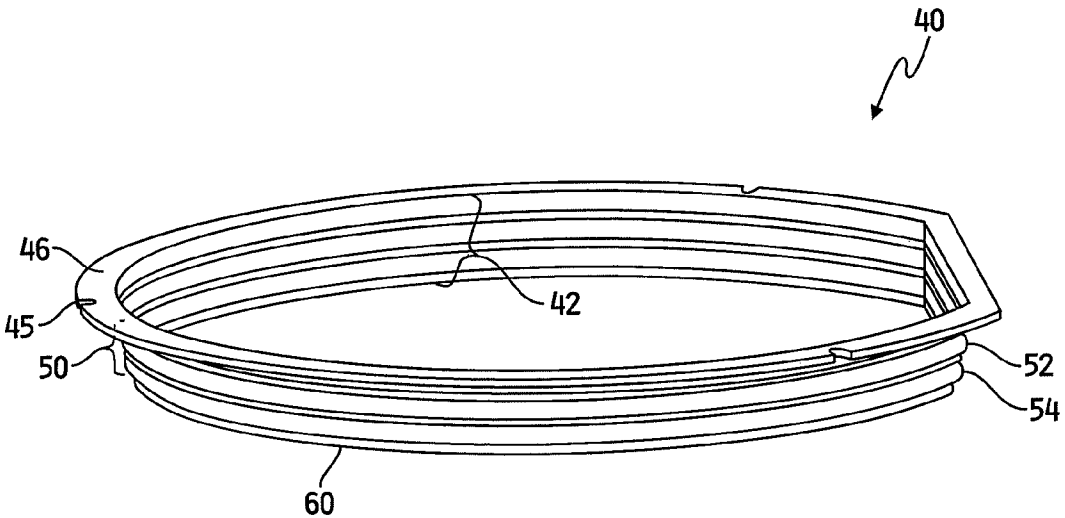
FIG. 4A illustrates a perspective view of an exemplary skew.

Referring to FIGS. 2-4, in an exemplary embodiment, skew 40 of roof system 20 includes upper surface 41, internal surface 42 (as best shown in FIG. 4A), water pipe circuitry 50, and may also include solid round 60. Skew 40 is the same shape as delta 30, and thus may be any shape necessary to configure to the EAF in which it is used. For example, skew 40 may be frustoconical in shape. Skew 40 also may be substantially annular. Regardless of its specific shape, skew 40 is the same shape as delta 30. In turn, refractory skew lining 70 (discussed below) is also the same shape as delta 30 and skew 40. Notches 45, which are located on upper surface 41 of skew 40, are used in positioning skew 40 and delta 30 such that electrodes 16 are properly aligned when inserted into apertures 33. Flange 46 contacts EAF 10 and supports skew 40.

Figure 4B:
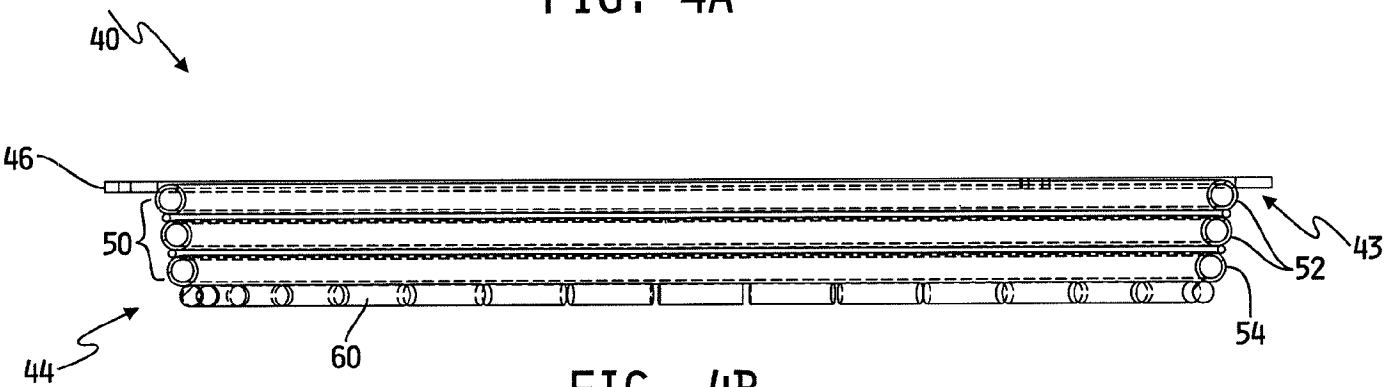
FIG. 4B illustrates a cross-sectional view of an exemplary skew.

FIGS. 4A-B depict an exemplary skew 40 prior to the addition of refractory skew lining 70. As FIG. 4B makes clear, water pipe circuitry 50 and solid round 60 are adjacent to, and may be an integral part of, exemplary skew 40. Additionally, a gap may exist between each pipe in circuitry 50 as well as between each pipe 50 and the solid round 60, and is created when the pipes 50 and solid round 60 are welded together. Accordingly, interior surface 42 may be any surface that would be exposed prior to the addition of refractory skew lining 70 or a delta 30. For example, in one embodiment, interior surface 42 may include any gap between water pipe 50 and solid round 60, as well as the actual pipe circuitry 50 and solid round 60. In another embodiment, where there are no gaps between the pipes in pipe circuitry 50 or solid round 60, internal surface 42 may be the portions of the pipe circuitry 50 and solid round 60 that would be exposed prior to the addition of refractory skew lining 70. In an exemplary embodiment, refractory skew lining 70 is molded to skew 40 such that lining 70 affixes to internal surface 42.

Referring still to FIGS. 4A and 4B, water pipe circuitry 50 is used to regulate the temperature of roof system 20. Water pipe circuitry 50 extends vertically from proximal end 43 of skew 40 toward distal end 44. In one embodiment, solid round 60 may be located at distal end 44, and in this embodiment, water pipe circuitry 50 extends distally to solid round 60.

In an exemplary embodiment, water pipe circuitry 50 may include a single circuit or multiple circuits, as indicated by circuits 52 and 54. In this exemplary embodiment, circuit 52 includes multiple water pipes, supplied by a single water source (not shown), and circuit 54—the distal-most circuit—includes a single water pipe, supplied by a separate water source (not shown). Alternatively, circuits 52 and 54 may be supplied by the same water source. It should be understood that the circuitries discussed in the present disclosure and depicted in FIGS. 4A and 4B are exemplary only; therefore, the present disclosure may also include a skew 40 wherein more than three water pipes and more than two circuits are implemented. Additionally, circuitry 50 may extend the entire circumference of skew 40, regardless of the shape of skew 40.

In such an embodiment, circuitry 50 can be used to regulate the temperature of both refractory skew lining 70 and refractory delta 30.

Referring still to FIGS. 4A and 4B, skew 40 may also contain solid round 60. Solid round 60 is comprised of any conductive metal, and is located at distal end 44 of skew 40. Accordingly, solid round 60 is located closest to melting chamber 12, and may be exposed to electrodes 16. In one embodiment, solid round 60 is configured such that, prior to the addition of refractory skew lining 70, at least a portion of its surface is exposed, which exposed surface acts, at least in part, as internal surface 42. Additionally, in yet another exemplary embodiment, solid round 60 may be configured to be an integral part of skew 40 such that a gap exists between metal pipe 60 and water pipes 50, where each gap, along with the exposed portion of each pipe, together act as internal surface 42.

In one embodiment, solid round 60 is present wherever water pipe circuitry 50 is located; therefore, solid round 60 may extend the entire circumference of skew 40. In another exemplary embodiment, solid round 60 may be implemented in sectional pieces along the circumference of skew 40, as best depicted in FIG. 4B.

Referring to the exemplary embodiments in FIGS. 2 and 3, refractory skew lining 70 is affixed to internal surface 42 of skew 40. Accordingly, refractory skew lining 70 is affixed to at least the exposed pipe surfaces in circuitries 50 and, if present, solid round 60, as described above. Refractory skew lining 70 may be of any desired width. In one exemplary embodiment, lining 70 is capable of holding the weight of refractory delta 30. The refractory material used in refractory skew lining 70 may be the same as that used in refractory delta 30, or, alternatively, may be a different refractory material. In this exemplary embodiment, refractory skew lining 70 is substantially annular in shape, and extends from proximal end 43 of skew 40 to distal end 44 of skew 40. In another exemplary embodiment, refractory skew lining 70 may extend above proximal end 33 and below distal end 44 of skew 40. Additionally, in an exemplary embodiment, the diameter of refractory skew lining 70 may decrease as lining 70 extends distally toward distal end 44 of skew 40.

The efficiency of the present disclosure is partially attributable to the ability to place a separate delta 30 on to a separate refractory skew lining 70 (or to size delta 30 such that it fits together with refractory skew lining 70). Again referring to FIGS. 2 and 3, in an exemplary embodiment, delta 30 is placed on refractory skew lining 70. In this embodiment, delta 30 is supported by shoulder 35 of delta 30 resting on a top surface of the refractory skew lining 70 as best shown in FIG. 3. This placement of delta 30 contributes to its efficiency, as lower surface 32 of delta 30 does not extend the complete length of refractory skew lining 70. Thus, delta 30, when placed on to refractory skew lining 70, is not as deep, and thus does not extend as far toward melting chamber 12, as known EAF deltas, thereby allowing delta 30 to be cooled in an efficient manner which increases the life span of delta 30 relative to known EAF deltas.

Figure 5:
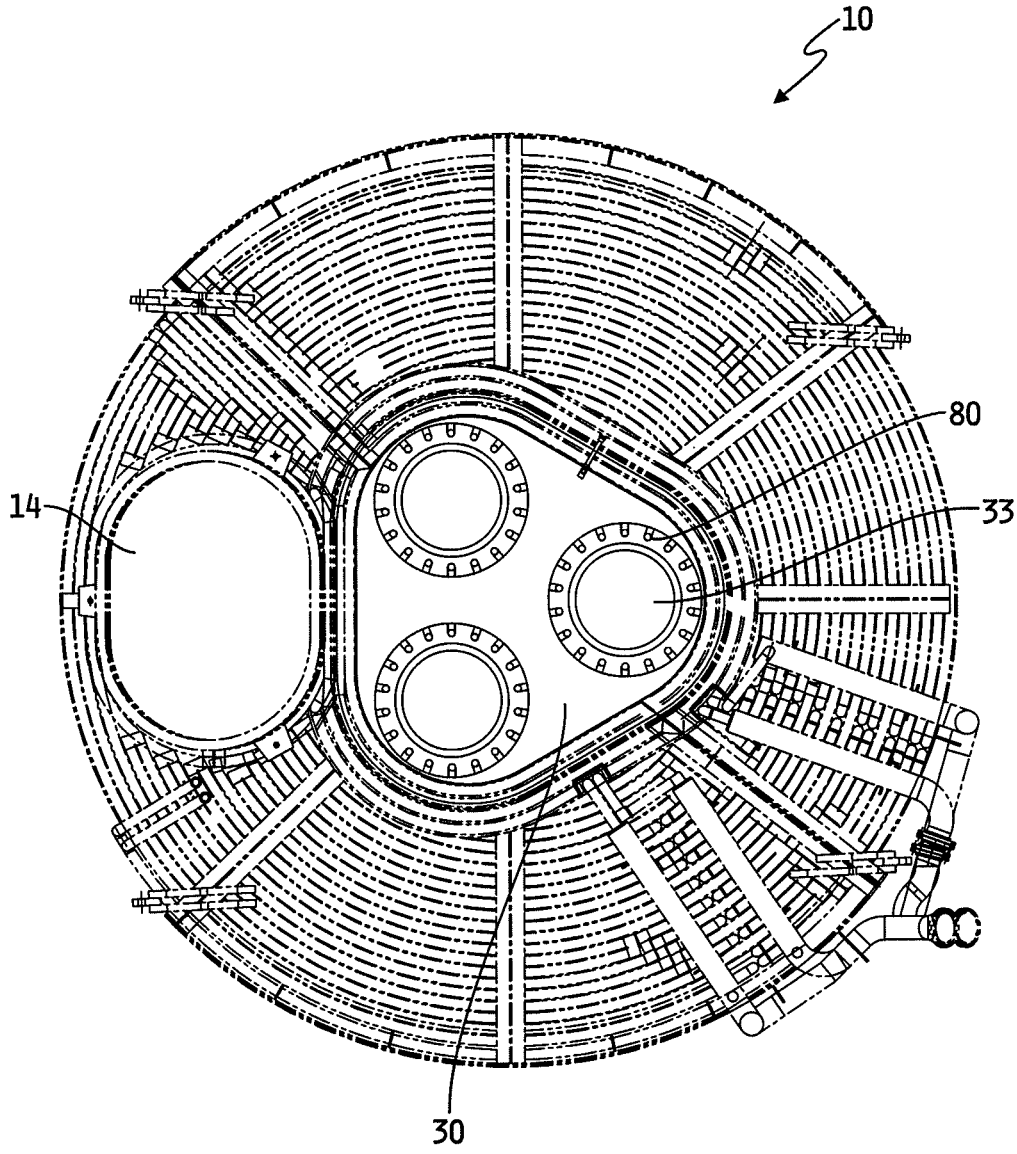
FIG. 5 illustrates a top view of an exemplary electric arc furnace.

Cooling mechanisms in addition to circuitry 50 also contribute to the efficiency of the present disclosure, and in particular the cooling of exemplary delta 30. For example, water sprayers 80 may be used to cool electrodes 16. Referring to FIG. 5, water sprayers 80, which are an integral part of EAF 10, surround electrodes 16. Sprayers 80 may be attached to the arms (not shown) of electrodes 16. It should be understood that sprayers 80 as embodied in FIG. 5 are exemplary only, and any configuration of waters sprayers for electrodes that is generally understood or implemented in the industry will suffice. The water streams generated by sprayers 80 naturally result in water that splashes off the electrodes 16 and on to upper surface 31 of delta 30. The location of exemplary delta 30 relative to the molten steel in chamber 12 allows the water that splashes off electrodes 16 to cool delta 30.

Figure 6:
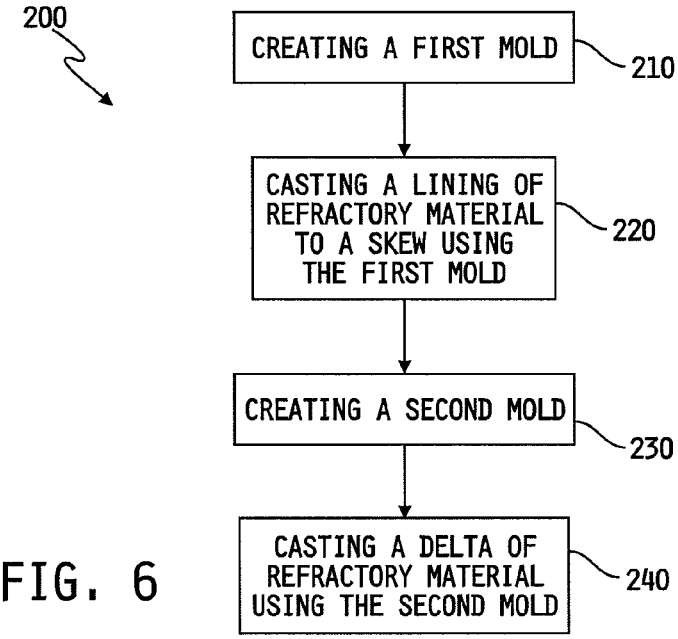
FIG. 6 illustrates a flow chart for a method of manufacturing an exemplary roof system of the present disclosure.

Referring now to FIG. 6, an exemplary method 200 for creating the roof system described above is provided. As illustrated in box 210, the first step of this exemplary method is to create a first mold. In an exemplary embodiment, the first mold may include a steel base plate and a second steel structure fixed to the base plate. A skew from an EAF is also fixed to the base plate such that a gap of pre-determined width is created between the second steel structure and the skew. As described above, the skew may be any shape necessary to configure to the EAF in which it is used. Accordingly, the second steel structure, which is affixed to the base plate, has the same shape as the skew. In one embodiment, an exemplary skew includes a proximal end, a distal end, an interior surface, and at least one circuitry of pipes integral to the interior surface of the skew. The skew may have at least one pipe circuitry or, alternatively, a plurality of pipe circuitries. Additionally, the skew may include a solid round located distal to the pipe circuitries. The solid round may be comprised of a conductive material. Regardless of the type or number of circuitries implemented with the skew, each circuitry may extend the entire circumference of the skew.

As illustrated in box 220 of FIG. 6, the second step of exemplary method 200 includes using the first mold (box 210) to cast a lining of refractory material to the skew. The refractory material can be any refractory material known or used in the art. In an exemplary embodiment, the lining of refractory material affixes to the internal surface of the skew and, accordingly, to any pipe circuitry or solid round integral to the skew. In this exemplary embodiment, the refractory lining is affixed to the interior surface and any pipe circuitry or solid round integral thereto through vibration techniques known in the art. Also, in this exemplary embodiment, the lining of refractory material extends from the proximal end of the skew toward to the distal end thereof. Additionally, the refractory lining is of a pre-determined width. And like exemplary skew 40 of the present disclosure, the refractory lining may be any shape necessary to configure to the EAF in which it is used.

As illustrated in box 230 in FIG. 6, the next step of exemplary method 200 is to create a second mold. As with the first mold, the second mold may be fabricated using steel. In an exemplary embodiment, the second mold includes a steel base plate as well as at least one steel structure sized according to the electrode(s) that will pass through the aperture in the delta. Accordingly, the second mold may include a plurality of steel structures sized according to the electrodes that will pass through the apertures in the delta. In this exemplary embodiment, the second mold may include a lip such that when a refractory delta is cast using the second mold (box 240), a circumferential shoulder is created between the proximal surface and the distal surface of the refractory delta. Finally, as with delta 30 in the roof system described above, the second mold (and thus the delta that is cast using second mold—box 240) may be any shape necessary to configure to the EAF in which the roof system created will be used.

As illustrated in box 240 in FIG. 6, the next step of exemplary method 200 involves casting a delta of refractory material using the second mold, the delta being sized to fit on to the refractory lining created in the second step (box 220). The refractory delta may or may not be of the same refractory material as the refractory lining. In an exemplary embodiment, the refractory delta has an upper surface and a lower surface wherein the circumference of the lower surface is smaller than the circumference of the upper surface. This difference creates a shoulder, or lip, which allows the refractory delta created in this step to be received by, and fit onto, the refractory lining created in the second step (box 220). In another exemplary embodiment, the delta cast in this step may fit against the refractory lining like a wedge, held in place by gravity. In yet another exemplary embodiment, the refractory delta created in this step also includes at least one aperture sized to receive at least one electrode. The refractory delta created in this step also includes at least one lifting apparatus, capable of aiding the process of moving and placing the delta onto, and removing the delta from, the refractory lining.

It should be understood that the order in which the steps of the exemplary method are performed is not limited to the order described above. For example, steps 1 and 3 (boxes 210 and 230, respectively) may occur simultaneously.

Figure 7:
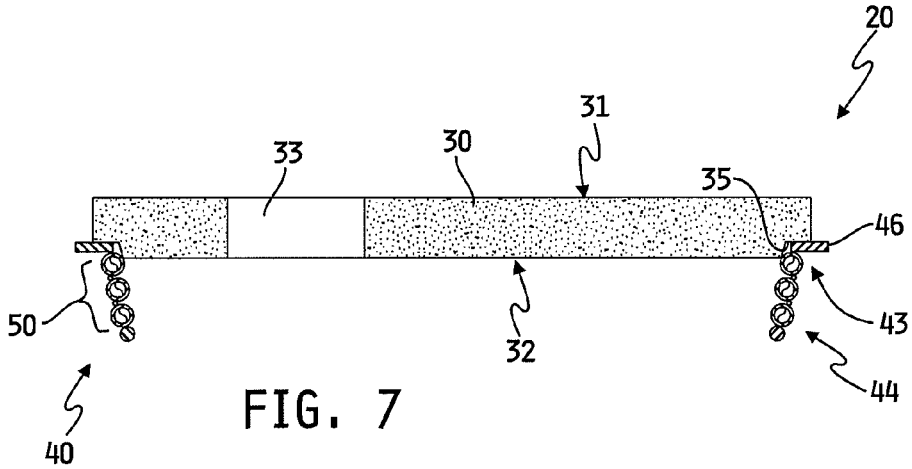
FIG. 7 illustrates a cross-sectional view of an exemplary roof system.

Referring now to FIG. 7, another embodiment of the present disclosure includes roof system 20 that includes a refractory delta 30 and skew 40, but does not include refractory skew lining 70. Accordingly, in this embodiment, delta 30 is sized to fit on to flange 46 of skew 40. In an exemplary embodiment, delta 30 illustratively includes upper surface 31, lower surface 32, at least one aperture 33 configured to receive an electrode 16, and shoulder 35. In the illustrated embodiment of FIG. 7, the shoulder 35 of delta 30 rests on a top surface of flange 46 to support the delta 30 on the skew 40. Delta 30 may include a plurality of apertures 33 configured to receive a plurality of electrodes 16. Additionally, in this embodiment, delta 30 extends distally toward melting chamber 12. However, in this illustrated embodiment, delta 40 does not extend as far as distal end 44 of skew 40.

Figure 8:
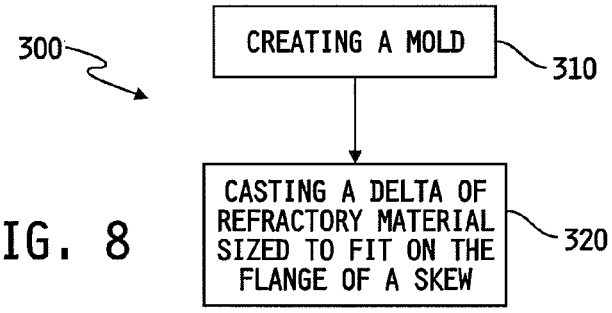
FIG. 8 illustrates a flow chart for a method of manufacturing an exemplary roof system of the present disclosure.

The embodiment of present disclosure disclosed in FIG. 7 and discussed above is created using an exemplary method 300 that includes the first step of creating a mold (box 310, FIG. 8), and a second step of casting a delta of refractory material using the mold (box 320, FIG. 8). The mold (box 310) may be fabricated using steel. In an exemplary embodiment, this mold includes a steel base plate as well as at least one steel structure sized according to the electrode(s) that will pass through the aperture in the delta. Accordingly, the mold may include a plurality of steel structures sized according to the electrodes that will pass through the apertures in the delta. In this exemplary embodiment, the second mold may include a lip such that when a refractory delta is cast using the second mold (box 320), a circumferential shoulder is created between the proximal surface and the distal surface of the refractory delta. Finally, the mold (and thus the delta that is cast using second mold—box 320) may be any shape necessary to configure to the EAF in which the roof system created will be used.

As illustrated in box 320 in FIG. 8, the next step of exemplary method 300 involves casting a delta of refractory material using the mold, the delta being sized to fit on to a flange of a skew. In an exemplary embodiment, the refractory delta has an upper surface and a lower surface wherein the circumference of the lower surface is smaller than the circumference of the upper surface. This difference creates a shoulder, or lip, which allows the refractory delta created in this step to be received by, and fit onto, a flange of a skew. In another exemplary embodiment, the delta cast in this step may fit against the skew like a wedge, held in place by gravity. In yet another exemplary embodiment, the refractory delta created in this step also includes at least one aperture sized to receive at least one electrode. The refractory delta created in this step also includes at least one lifting apparatus, capable of aiding the process of moving and placing the delta on to, and removing the delta from, the refractory lining.

In an exemplary implementation of the present disclosure, after refractory lining 70 and delta 40 have been cast, they are inserted into EAF 10 such that skew 40 is in contact with EAF 10 via flange 46, and delta 30 is placed on top of refractory lining 70. Delta 30 is then placed on to refractory skew lining 70 via shoulder 35, with refractory skew lining 70 being affixed to interior surface 42 of skew 40. Operation of EAF 10 begins by opening EAF 10 and allowing steel scrap to be placed into melting chamber 12. EAF 10 is then closed and electrodes 16 are inserted through apertures 33 in delta 30. Electricity is provided to electrodes 16, and electricity begins to arc between the electrodes and the steel scrap in melting chamber 12. This arcing is what generates the energy used to melt the steel scrap. At or near the same time the heat generation begins, the cooling systems of the present disclosure are activated. Specifically, the water source(s) used to supply water to water pipe circuitry 50 (including individual circuitries 52 and 54), and electrode sprayers 80 are activated. Water pipe circuitry 50 is used to cool refractory skew lining 70 as well as delta 30. Electrode sprayers 80 are used to cool electrodes 16, while the water that splashes off electrodes 16 cools delta 30 by landing on surface 31 thereof. The configuration of two separate pieces—delta 30 and refractory skew lining 70—allows them to be efficiently cooled, and as a result, this configuration extends the lifespan of both delta 30 and lining 70.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A roof system for an electric arc furnace, the system comprising:

a frustoconical, water-cooled skew forming part of a roof of the electric arc furnace and configured for removal from the electric arc furnace, the skew including an inner circumferential surface directed toward a central axis of the skew, the skew having a distal end that forms a central opening through which material is deposited into an interior of the furnace, the distal end facing the interior of the furnace;

a refractory delta having a proximal surface, a distal surface, an outer circumferential surface, and at least one aperture configured to receive at least one electrode; and a refractory lining affixed to the water-cooled skew and having an inner circumferential surface that surrounds the outer circumferential surface of the delta and an outer circumferential surface that engages the inner circumferential surface of the skew, the refractory lining extending beyond the distal end of the skew;

wherein the refractory delta does not extend distally to the distal end of the skew or a distal end of the refractory skew lining.

2. The roof system of claim 1 wherein the refractory delta includes a plurality of apertures sized to receive a plurality of electrodes.

3. The roof system of claim 1 wherein the refractory skew lining comprises a first refractory material and the refractory delta comprises a second refractory material.

4. The roof system of claim 3 wherein the first refractory material and the second refractory material are comprised of an identical refractory material.

5. The roof system of claim 3 wherein the first refractory material and the second refractory material are different refractory materials.

6. The roof system of claim 1 wherein the skew is substantially annular.

7. The roof system of claim 1 wherein the refractory skew lining is affixed to the inner circumferential surface of the skew.

8. The roof system of claim 7 wherein the refractory skew lining is annular.

9. The roof system of claim 7 wherein the refractory skew lining is frustoconical.

10. The roof system of claim 7 wherein the refractory skew lining has a diameter that decreases as the refractory lining extends toward the distal end of the skew.

11. The roof system of claim 1 wherein the refractory delta is formed to include a shoulder located between the proximal and distal surfaces of the refractory delta, the shoulder being configured to engage a top surface of the refractory skew lining to support the refractory delta.

* * * * *